United States Patent [19]

Ernsberger

[11] Patent Number: 4,765,483

[45] **Date of Patent: * Aug. 23, 1988**

[54] MEANS FOR APPLYING DESIGNS TO AUTO EXTERIORS

[76] Inventor: Earl R. Ernsberger, 104 Quail Dr., Dublin, Pa. 18917

[ * ] Notice: The portion of the term of this patent subsequent to Jan. 6, 2004 has been disclaimed.

[21] Appl. No.: 909,179

[22] Filed: Sep. 19, 1986

Related U.S. Application Data

[63] Continuation-in-part of Ser. No. 753,929, Jul. 11, 1985, Pat. No. 4,634,607.

[51] Int. Cl.[4] ..... B05D 1/32

[52] U.S. Cl. ..... 206/575; 427/282

[58] Field of Search ..... 427/282, 286, 300; 118/301, 504; 101/127, 128.21, 129; 206/223, 229, 224, 575

[56] References Cited

U.S. PATENT DOCUMENTS

| | | | |
|---|---|---|---|
| 2,383,913 | 8/1945 | Leander | 101/129 X |
| 2,959,152 | 11/1960 | Byers et al. | 118/505 |
| 3,087,707 | 4/1963 | Moonan | 366/130 |
| 3,334,003 | 8/1967 | Edwards | 206/229 X |

*Primary Examiner*—William Price

*Attorney, Agent, or Firm*—Joseph W. Molasky & Assocs.

[57] ABSTRACT

A kit for applying indicia to the surface of an auto body by spray means.

The kit includes a pressurized container for applying enamel in vaporized form to a precut mask affixed to the surface of an auto body. The uniquely thin character of the mask and a heavily pigmented enamel composition combine to ensure the reproduction of designs of consistently high quality.

15 Claims, No Drawings

MEANS FOR APPLYING DESIGNS TO AUTO EXTERIORS

This application is a continuation-in-part of applicant's copending application Ser. No. 753,929, now Pat. No. 4,634,607

This invention relates to a kit and method for applying indicia such as lettering, designs and numerals to auto body exteriors.

In Ser. No. 753,929 there is described a method for imparting designs to an auto body by using a brush to apply heavily pigmented enamel onto a precut mask. A brush is employed because it provides means for controlling paint flow and it allows the user to enrich the design by conferring upon the work a personal character which would otherwise be impossible to achieve.

Unfortunately, however, there are disadvantages to the use of brush means because this mode of application can result in paint overloading and poor quality reproduction.

Accordingly, there is a need for improvement in the means by which enamels are applied to precut masks for producing designs on auto body exteriors.

BACKGROUND

The extent to which indicia can be faithfully applied to an auto body by brush means depends to a large extent upon the quality of the bristles and the type of enamel employed.

In copending Application Ser. No. 753,929 the brush therein described consists of bristles which are cut to the same length so that the ends form a flat nap. Bristles having a tapered nap are to be avoided because the enamel has a tendency to flow to the fiber ends and become loaded in a narrow zone only. Under such conditions the applied enamel will fill the cutout portions of the mask to an excessive degree and this results in a design of high relief which has a tendency to peel away when the mask is removed.

Even brushes having uniformly flat surfaces are not entirely satisfactory because only the very ends of the bristles can be dipped and these must be pounced on a clean sheet to ensure that the paint is uniformly dispersed before it can be applied to the stencilled design. Moreover, the application of the enamel requires that the brush be held perpendicular to the mask surface and applied with an up-and-down motion to ensure that the cut out portions are filled equally. Unless this procedure is followed carefully the integrity of the design may be compromised.

Accordingly, there is a need for means by which enamel can be applied to a precut mask with relative ease so that faithful reproductions of a desired indicia can be reproduced on auto body surfaces by a person of ordinary skill.

THE INVENTION

It is an object of this invention to provide an auto design kit in which pigmented enamel is applied to a precut mask from a pressurized container in spray form to produce professional-like designs on auto body exteriors.

Another object is to provide an auto design kit in which the precut mask is formed from uniformly thin sheets of polyvinyl chloride which are coated on one side with a rubber based adhesive. These and other objects will be apparent from the following description which describes with particularity the components of the present kit and the method by which it is employed.

The kit of this invention consists essentially of the following components:

(1) A mask of precut letters, numerals and/or designs fabricated from polyvinyl chloride in sheet form. This mask has a thickness of from about 1.75–2.50 mils and it is impregnated on one side with a layer of rubber based adhesive having an essentially uniform thickness of from about 0.25–0.75 mils. The adhesive layer is covered by a liquid impervious sheet of waterproof paper, plastic or equivalent material which can be peeled away to expose the adhesive layer.

(2) A pressurized container equipped with nozzle means for spraying a heavily pigmented enamel onto and within said mask in vaporized form.

The adhesive layer must be capable of securely maintaining the precut mask in a fixed position on the auto body and, therefore, it is essential that the adhesive layer exhibit high initial tack. The adhesive layer which is bonded to the underside of the mask is characterized by an adhesive strength of about 25 ounces per square inch, a tensile strength of approximately 22 pounds per square inch and an elongation value of about 40%. When superimposed upon the polyvinyl chloride (PVC) sheet the combination of PVC sheet and adhesive layer combine to afford a dual-layer mask having a thickness of from about 2–3 mils.

Superimposed on the adhesive layer is a liquid impervious sheet which serves as a disposable liner. This liner has a thickness of from about 1.75–2.75 mils and it may be fabricated from any suitably strong sheet material as, for example, waterproof paper having a high tensile strength or synthetic materials such as polyethylene or polypropylene and the like.

The mask is preferably formed from polyvinyl chloride sheeting because it possesses the impermeability, strength and elasticity needed to resist tearing while also serving as a substrate for the adhesive layer.

The adhesive layer may consist of any pressure sensitive substance as, for example, conventional water dispersions of reclaimed rubber, including natural rubbers which contain up to 30% solids. Adhesive layers conforming to this composition have the ability to adhere not only to the surface onto which it is impressed but, in addition, to the substrate or underside of the mask.

The enamel is dispensed in aerosol form from a pressurized container equipped with nozzle means for spraying onto and within the cutout portions of the mask. The enamel composition is an oil based acylic which is heavily pigmented and which contains a high concentration of drying agents. Typical of the enamels which may be used for this purpose are, for example, "Sign Painter's Chromatic Lettering Enamel" manufactured by Chromatic Paint Corporation of Carnersville, N.Y. This type of enamel is uniquely suitable for the reproduction of fine lettering and designs because it combines the advantages of high opacity with fast drying and easy cleanup; moreover, it may be thinned with mineral spirits if a less viscous composition is desired. It dries to a durable finish of long lasting lustre at temperatures about 25° C.

The container is equipped with a nozzle having an orifice in which there is located a pinpoint aperture for precision spraying. The container contents are dispersed within a gas to form colloidal particles which are maintained under pressure and emitted through the nozzle opening in aerosol form.

PREFERRED EMBODIMENT

This invention will now be illustrated by describing the stepwise procedure for utilizing the kit of this invention to create designs on an auto body.

The area of the auto body which has been selected for striping or designing is first cleansed thoroughly as, for example, by washing with Surfa Prep, a product manufactured by Chemical Products Company, Inc., Old post Road, P.O. Box 440, Aberdeen, Md. or Ditzler's Acryli-Clean, a wax and grease remover manufactured by PPG Finishes, P.O. Box 3510, Troy, Mich. The washed area is then wiped dry with a soft cloth impregnated with denatured alcohol to ensure removal of any film or residue which may have resulted from the use of the cleansing agent. Thereafter, the surface is again dried with a soft dry cloth.

The peelable liner is then removed from the selected mask onto the exposed adhesive layer and is impressed onto the auto body surface. The mask is applied with firm even pressure over its entire length to provide complete adhesion and ensure that the enamel which is to be applied will not run beneath the mask in the cutout areas. Because the mask is fabricated from a uniquely thin and flexible polyvinyl chloride film it conforms easily to the contours of the body panels.

Once the mask has been applied the aerosol container is held a short distance from the surface of the mask and the push-button nozzle is depressed for spraying onto the cutout portions. The pinpoint aperture in the nozzle directs the spray directly onto the cutout areas; however, there are certain techniques which have been found desirable for achieving an accurate reproduction of the desired design and these are discussed below.

Although the pinpoint nozzle is uniquely useful for directing limited quantities of enamel onto the cutout portions of the mask it has also been found that efficiencies can be achieved by depressing the button nozzle in successively rapid bursts so that only minor quantities of enamel are emitted at any one time. This press-and-release procedure ensures that no single portion of the cutout will receive an excessive amount of enamel and paint overloading will thus be avoided.

Alternatively, the orifice in push button nozzle is made to accept a hollow reed-like tube through which the enamel may be emitted for application to the mask. This hollow tube may be formed from plastic or other similar synthetic material and it is retained in place by fitting engagement until the spraying step is concluded following which it may be withdrawn and cleansed for use in a subsequent operation.

When the enamel has dried, the mask is removed slowly by withdrawing same in an upwards direction. Then striping has been applied it is most desirable to peel away the mask or tape in a mode which is parallel to the striping so as to avoid the inadvertent chipping of an enamelled segment.

This invention has been described by reference to precise embodiments; however, it will be appreciated by those skilled in the art that the kit and methods described in this application are subject to variation and modification and to the extent that those modifications and variations are within the skill of the artisan to perform they are considered as being within the scope of the appended claims.

What is claimed is:

1. An auto design kit which comprises:

(1) a precut mask fabricated from a polyvinyl chloride sheet having a thickness of from about 1.75–2.50 mils and being characterized by a rubber based adhesive on one side; and (2) a pressurized container equipped with nozzle means for spraying onto said mask a heavily pigmented enamel in vaporized form, said enamel being characterized by a high concentration of drying oils.

2. The kit of claim 1 wherein said nozzle means consists essentially of an orifice into which a hollow tube may be inserted to direct said spray onto localized areas of said mask.

3. The kit according to claim 1 wherein said adhesive is natural latex rubber having an essentially uniform thickness of from about 0.25–0.75 mils.

4. The kit according to claim 1 wherein said adhesive has an adhesive strength of about 25 ounces per square inch.

5. The kit according to claim 1 wherein said adhesive has a tensile strength of about 22 pounds per square inch and an elongation value of about 40%.

6. The kit according to claim 1 wherein said enamel is an oil based acrylic.

7. The kit according to claim 1 wherein said adhesive is covered by a disposable liner.

8. A method for applying designs to an auto body which comprises:

(1) adhesively securing onto said auto body a precut mask fabricated from a polyvinyl cloride sheet having a thickness of from about 1.75–2.50 mils said sheet being characterized by a rubber based adhesive on one side; and (2) spraying onto and within said mask a heavily pigmented enamel having a high concentration of drying oils.

9. The method according to claim 8 wherein said spraying step is achieved by nozzle means.

10. The method according to claim 9 wherein a hollow tube is inserted into the orifice of said nozzle to direct said spray onto localized areas of said mask,

11. The method according to claim 8 wherein said adhesive is natural latex rubber applied in an essentially uniform thickness of from about 0.25–0.75 mils.

12. The method according to claim 8 wherein said adhesive has an adhesive strength of about 25 ounces per square inch.

13. The method according to claim 8 wherein said adhesive has a tensile strength of about 22 pounds per square inch and an elongation value of about 40%.

14. The method according to claim 8 wherein said enamel is an oil based acrylic.

15. The method according to claim 8 wherein said adhesive is covered by a disposable liner.

* * * * *